US009696034B2

(12) United States Patent
Krichtafovitch et al.

(10) Patent No.: US 9,696,034 B2
(45) Date of Patent: Jul. 4, 2017

(54) COMBUSTION SYSTEM INCLUDING ONE OR MORE FLAME ANCHORING ELECTRODES AND RELATED METHODS

(71) Applicant: CLEARSIGN COMBUSTION CORPORATION, Seattle, WA (US)

(72) Inventors: Igor A. Krichtafovitch, Kirkland, WA (US); Joseph Colannino, Mercer Island, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 232 days.

(21) Appl. No.: 14/192,309

(22) Filed: Feb. 27, 2014

(65) Prior Publication Data

US 2014/0248566 A1 Sep. 4, 2014

Related U.S. Application Data

(60) Provisional application No. 61/772,423, filed on Mar. 4, 2013.

(51) Int. Cl.
*F23N 5/12* (2006.01)
*F23D 14/84* (2006.01)
(Continued)

(52) U.S. Cl.
CPC ..... *F23N 5/00* (2013.01); *F23C 99/001* (2013.01); *F23D 11/406* (2013.01); *F23D 14/84* (2013.01)

(58) Field of Classification Search
CPC ... F23N 5/00; F23N 5/12; F23N 5/265; F23C 99/001; F23D 14/84; F23D 11/406; F23D 11/32
(Continued)

(56) References Cited

U.S. PATENT DOCUMENTS 2,112,736 A * 3/1938 Cockrell ..... F23N 5/123 313/53
2,127,977 A * 8/1938 Lamb ..... F23N 5/126 236/15 E
(Continued)

FOREIGN PATENT DOCUMENTS

DE 10159225 A1 * 7/2002 ..... F23N 5/123
DE EP 2136141 A2 * 12/2009 ..... F23N 5/123
(Continued)

OTHER PUBLICATIONS

Timothy J.C. Dolmansley et al., Electrical Modification of Combustion and the Affect of Electrode Geometry on the Field Produced, Modelling and Simulation in Engineering, May 26, 2011, 1-13, vol. 2011, Himdawi Publishing Corporation.
(Continued)

*Primary Examiner* — Gregory Huson
*Assistant Examiner* — Daniel E Namay
(74) *Attorney, Agent, or Firm* — Dorsey & Whitney LLP

(57) ABSTRACT

In an embodiment, a combustion system includes a burner, at least one charging electrode, flame anchoring electrode(s), and at least one voltage power supply. The burner is configured to discharge fuel into a combustion volume in which the fuel and an oxidizer are ignited to generate a flame. The charging electrode is positioned proximate to the flame. The charging electrode provides charges to the flame to generate a charged flame. The flame anchoring electrode(s) are disposed adjacent to the burner and proximate to a base portion of the charged flame. The voltage power supply is electrically coupled to each of the flame anchoring electrode(s) and the charging electrode. The at least one voltage power supply applies one or more electrical potentials to each of the flame anchoring electrode(s) so that the charged flame is anchored at a predetermined location.

29 Claims, 3 Drawing Sheets

(51) Int. Cl.

| | |
|---|---|
| ***F23N 5/00*** | (2006.01) |
| ***F23C 99/00*** | (2006.01) |
| ***F23D 11/40*** | (2006.01) |
| *F23D 11/32* | (2006.01) |

(58) Field of Classification Search

USPC ..... 431/8, 25, 202, 2; 361/225, 229, 234; 60/749, 39.55

IPC ..... F23N 5/12; F23D 11/32; F23C 99/00, 14/84

See application file for complete search history.

(56) References Cited

U.S. PATENT DOCUMENTS 2,386,648 A * 10/1945 Aubert ..... F23N 5/12 307/653
2,604,936 A * 7/1952 Kaehni ..... F23C 99/001 122/14.21
3,035,208 A * 5/1962 Clark ..... B64D 45/02 244/1 A
3,167,109 A 1/1965 Wobig
3,224,485 A 12/1965 Blomgren, Sr. et al.
3,306,338 A 2/1967 Wright et al.
3,416,870 A * 12/1968 Wright ..... F23C 99/001 204/168
3,749,545 A 7/1973 Velkoff
3,841,824 A 10/1974 Bethel
4,020,388 A 4/1977 Pratt, Jr.
4,052,139 A * 10/1977 Paillaud ..... B01J 19/12 123/1 A
4,091,779 A 5/1978 Saufferer et al.
4,111,636 A 9/1978 Goldberg
5,090,891 A * 2/1992 Hemsath ..... F23C 15/00 122/24
5,784,889 A 7/1998 Joos et al.
6,211,617 B1 * 4/2001 Deegan ..... H01Q 1/366 313/231.31
6,676,404 B2 * 1/2004 Lochschmied ..... F23N 5/123 340/579
7,137,808 B2 11/2006 Branston et al.
7,243,496 B2 7/2007 Pavlik et al.
7,523,603 B2 4/2009 Hagen et al.
7,625,531 B1 * 12/2009 Coates ..... F02M 27/042 422/186.04
7,845,937 B2 * 12/2010 Hammer ..... F23C 99/001 324/76.21
8,082,725 B2 12/2011 Younsi et al.
8,851,882 B2 10/2014 Hartwick et al.
8,881,535 B2 * 11/2014 Hartwick ..... F23D 14/84 431/8
8,911,699 B2 12/2014 Colannino et al.
2003/0203245 A1 10/2003 Dessiatoun et al.
2004/0185397 A1 * 9/2004 Branston ..... F23C 99/001 431/2
2005/0208442 A1 9/2005 Heiligers et al.
2006/0165555 A1 7/2006 Spielman et al.
2006/0214020 A1 * 9/2006 Suda ..... A61L 2/22 239/3
2007/0020567 A1 1/2007 Branston et al.
2008/0044781 A1 * 2/2008 Stolyarenko ..... F23B 7/00 431/268
2008/0145802 A1 6/2008 Hammer et al.
2008/0173270 A1 * 7/2008 Coates ..... F02C 3/20 123/143 B
2009/0253086 A1 * 10/2009 Volkert ..... F23C 99/006 431/66
2011/0027734 A1 2/2011 Hartwick et al.
2011/0072786 A1 3/2011 Tokuda et al.
2011/0203771 A1 8/2011 Goodson et al.
2012/0156628 A1 * 6/2012 Lochschmied ..... F23N 5/123 431/78
2012/0231398 A1 * 9/2012 Carpentier ..... F23C 99/00 431/2
2012/0247436 A1 * 10/2012 Toneatto ..... F02M 27/04 123/539
2012/0276487 A1 * 11/2012 Hangauer ..... F23N 5/123 431/75
2012/0317985 A1 * 12/2012 Hartwick ..... F23D 14/84 60/722
2013/0004902 A1 1/2013 Goodson et al.
2013/0021715 A1 * 1/2013 Jewell-Larsen ..... B03C 3/41 361/225
2013/0071142 A1 * 3/2013 Kadowaki ..... G03G 15/0291 399/171
2013/0071794 A1 3/2013 Colannino et al.
2013/0170090 A1 7/2013 Colannino et al.
2013/0230810 A1 9/2013 Goodson et al.
2013/0230811 A1 * 9/2013 Goodson ..... F23C 99/001 431/4
2013/0255482 A1 10/2013 Goodson
2013/0255548 A1 * 10/2013 Goodson ..... F23G 5/442 110/342
2013/0255549 A1 10/2013 Sonnichsen et al.
2013/0260321 A1 10/2013 Colannino et al.
2013/0291552 A1 11/2013 Smith et al.
2013/0323655 A1 12/2013 Krichtafovitch et al.
2013/0323661 A1 12/2013 Goodson et al.
2013/0333279 A1 12/2013 Osler et al.
2013/0336352 A1 12/2013 Colannino et al.
2014/0038113 A1 2/2014 Breidenthal et al.
2014/0051030 A1 2/2014 Colannino et al.
2014/0065558 A1 3/2014 Colannino et al.
2014/0076212 A1 3/2014 Goodson et al.
2014/0080070 A1 3/2014 Krichtafovitch et al.
2014/0162195 A1 6/2014 Lee et al.
2014/0162196 A1 6/2014 Krichtafovitch et al.
2014/0162197 A1 6/2014 Krichtafovitch et al.
2014/0162198 A1 6/2014 Krichtafovitch et al.
2014/0170569 A1 6/2014 Anderson et al.
2014/0170571 A1 * 6/2014 Casasanta, III ..... B22F 3/1055 431/8
2014/0170575 A1 6/2014 Krichtafovitch
2014/0170576 A1 6/2014 Colannino et al.
2014/0170577 A1 * 6/2014 Colannino ..... F23C 99/001 431/253
2014/0186778 A1 7/2014 Colannino et al.
2014/0196368 A1 7/2014 Wiklof
2014/0196369 A1 7/2014 Wiklof
2014/0208758 A1 7/2014 Breidenthal et al.
2014/0212820 A1 7/2014 Colannino et al.
2014/0216401 A1 8/2014 Colannino et al.
2014/0227645 A1 8/2014 Krichtafovitch et al.
2014/0227646 A1 8/2014 Krichtafovitch et al.
2014/0227649 A1 8/2014 Krichtafovitch et al.
2014/0234786 A1 8/2014 Ruiz et al.
2014/0234789 A1 8/2014 Ruiz et al.
2014/0255855 A1 * 9/2014 Krichtafovitch ..... F23N 5/00 431/2
2014/0272730 A1 * 9/2014 Krichtafovitch ..... F23C 99/001 431/6
2014/0287368 A1 * 9/2014 Krichtafovitch ..... F23N 5/00 431/8
2014/0338350 A1 11/2014 Breidenthal et al.
2015/0004550 A1 * 1/2015 Tzavaras ..... F02M 27/06 431/2
2015/0047363 A1 * 2/2015 Steinwandel ..... F02C 7/00 60/772
2015/0079524 A1 3/2015 Colannino et al.
2015/0107260 A1 4/2015 Colannino et al.
2015/0118629 A1 4/2015 Colannino et al.
2015/0121890 A1 5/2015 Colannino et al.
2015/0140498 A1 5/2015 Colannino
2015/0147704 A1 5/2015 Krichtafovitch et al.
2015/0147705 A1 5/2015 Colannino et al.
2015/0147706 A1 5/2015 Krichtafovitch et al.
2015/0219333 A1 8/2015 Colannino et al.
2015/0241057 A1 8/2015 Krichtafovitch et al.
2015/0338089 A1 11/2015 Krichtafovitch et al.
2015/0345780 A1 12/2015 Krichtafovitch
2015/0345781 A1 12/2015 Krichtafovitch et al.

(56) References Cited

U.S. PATENT DOCUMENTS

| | | | | |
|---|---|---|---|---|
| 2015/0362178 | A1 | 12/2015 | Karkow et al. | |
| 2016/0047547 | A1* | 2/2016 | Barels | F23N 1/002 122/14.2 |
| 2016/0161115 | A1 | 6/2016 | Krichtafovitch et al. | |

FOREIGN PATENT DOCUMENTS

| | | | | | |
|---|---|---|---|---|---|
| EP | 0844434 | | | 5/1998 | |
| EP | 1139020 | | | 8/2006 | |
| FR | 2577304 | | | 12/1989 | |
| GB | 1042014 | | | 9/1966 | |
| JP | 53006929 | A | * | 1/1978 | F23N 1/022 |
| JP | 53006930 | A | * | 1/1978 | F23N 1/022 |
| JP | 54093232 | A | * | 7/1979 | F23N 5/12 |
| JP | S60216111 | | | 10/1985 | |
| JP | 61036607 | A | * | 2/1986 | F23C 99/001 |
| JP | 61-265404 | | | 11/1986 | |
| JP | 63217138 | A | * | 9/1988 | F23N 5/00 |
| JP | 04325770 | A | * | 11/1992 | B05B 1/3442 |
| JP | 07048136 | A | * | 2/1995 | C03B 37/0142 |
| JP | 11083013 | A | * | 3/1999 | |
| JP | 2000088244 | A | * | 3/2000 | |
| JP | 2001/021110 | | | 1/2001 | |
| JP | 2001-033040 | | | 2/2001 | |
| WO | WO 96/01394 | | | 1/1996 | |
| WO | WO 2013/181569 | | | 12/2013 | |

OTHER PUBLICATIONS

F. Altendorfner et al., Electric Field Effects on Emissions and Flame Stability with Optimized Electric Field Geometry, The European Combustion Meeting ECM 2007, 2007, 1-6, Germany.

M. Zake et al., "Electric Field Control of NOx Formation in the Flame Channel Flows." Global Nest: The Int. J. May 2000, vol. 2, No. 1, pp. 99-108.

* cited by examiner

COMBUSTION SYSTEM INCLUDING ONE OR MORE FLAME ANCHORING ELECTRODES AND RELATED METHODS

CROSS-REFERENCE TO RELATED APPLICATIONS

This application claims priority to U.S. Provisional Patent Application No. 61/772,423 filed on 4 Mar. 2013; which, to the extent not inconsistent with the disclosure herein, is incorporated by reference.

BACKGROUND

Electric-field-based combustion control systems use electric fields to manipulate the movement of electrically charged molecules (e.g., ions) that are a natural production of the combustion process. The controlled electric field creates electrostatic forces (e.g., Coulombic body forces) within a gas cloud created by the combustion process that can be manipulated to control flame shape, heat transfer, and other flame characteristics. At the same time, the controlled electric field can help influence combustion chemistry to suppress formation of pollutants at the flame source.

Generally, these combustion control systems involve the use of one or two or more tubular, planar, or post-type electrodes fabricated from macroscopic metallic sheets, pipes, or rods. However, the ability of such electrodes to control electric fields can be limited and lacking in precision. Moreover, such electrodes can be susceptible to heat-induced failure and/or significant wear.

Therefore, developers and users of combustion control systems continue to seek improved designs for combustion control systems.

SUMMARY

Embodiments disclosed herein relate to combustion systems configured to control a position of a flame within a combustion volume of a combustion system. In an embodiment, a combustion system includes a burner, at least one charging electrode, one or more flame anchoring electrodes, and at least one voltage power supply. The burner is configured to discharge fuel into a combustion volume in which the fuel and an oxidizer are ignited to generate a flame. The at least one charging electrode is positioned proximate to the flame and, in some embodiments, the at least one charging electrode does not make contact with the flame. The at least one charging electrode is configured to charge the flame to generate a charged flame. The one or more flame anchoring electrodes are disposed adjacent to the burner and proximate to a base portion of the charged flame and, in some embodiments, the one or more flame anchoring electrodes are positioned so that they do not make contact with the charged flame. The at least one voltage power supply is electrically coupled to each of the one or more flame anchoring electrodes and the at least one charging electrode. The at least one voltage power supply is configured to apply one or more electrical potentials to each of the one or more flame anchoring electrodes so that the charged flame may be stably positioned at a predetermined location.

In an embodiment, a method for positioning a flame within a combustion volume is disclosed. A flow including fuel is discharged from a burner into a combustion volume. The fuel and an oxidizer is ignited to generate a flame. The flame is charged to generate a charged flame. An electrical potential is applied to each of one or more flame anchoring electrodes positioned proximate to a base of the charged flame to stably positioning the charged flame at a predetermined location.

Features from any of the disclosed embodiments may be used in combination with one another, without limitation. In addition, other features and advantages of the present disclosure will become apparent to those of ordinary skill in the art through consideration of the following detailed description and the accompanying drawings.

DETAILED DESCRIPTION

Figure 1:
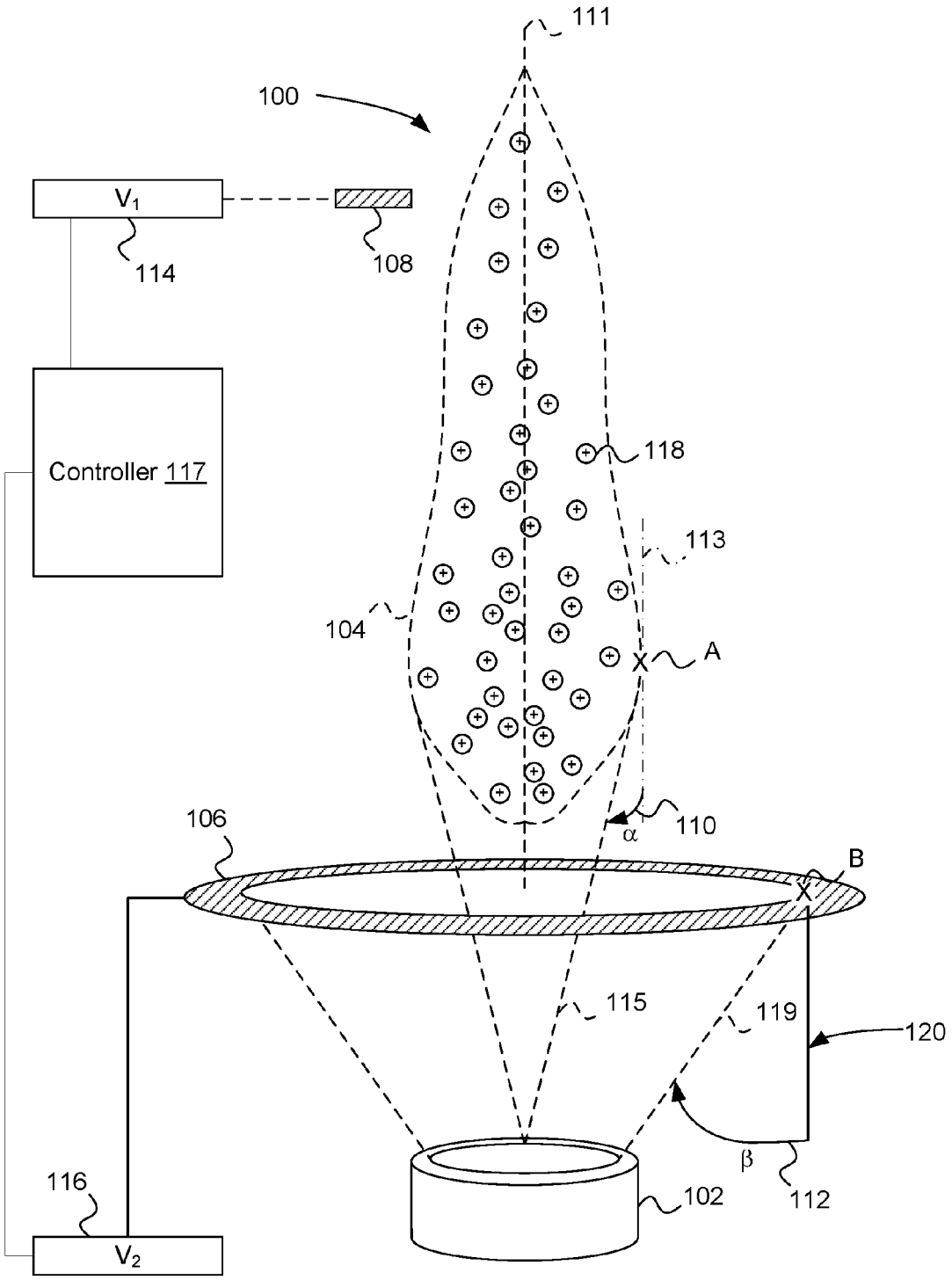
FIG. 1 is a schematic diagrammatic view of an embodiment of a combustion system including a charging electrode and a flame anchoring electrode for controlling an anchoring position of a flame.

Embodiments disclosed herein relate to combustion systems configured to control a position of a flame within a combustion volume of a combustion system. The disclosed combustion systems may be used to control a position of a flame away from walls, tubes, pipes, and other sensitive components within a combustion system.

In the following detailed description, reference is made to the accompanying drawings, which form a part hereof. In the drawings, which are not to scale or to proportion, similar symbols typically identify similar components, unless context dictates otherwise. The illustrative embodiments described in the detailed description, drawings and claims, are not meant to be limiting. Other embodiments may be used and/or and other changes may be made without departing from the spirit or scope of the present disclosure.

Controlling a flame anchoring position in certain areas within a combustion system may provide improve one or more of air/fuel mixing, flame stability, reduction of pollutants (e.g., $NO_R$, and CO), longer life, or higher reliability of equipment, among others. Furthermore, controlling the flame anchoring position within the combustion system may be important in ethylene crackers, steam methane reformers and other heaters, reactors and furnaces used in oil and chemical processing applications. In these systems, the position of the flame may need to be carefully controlled near pipes and other sensitive components to avoid excessive temperatures that may produce accumulation/penetration of species, such as carbon on the walls of internal structures (e.g., pipes/tubes), which may lead to the subsequent failure of these structures.

According to one or more embodiments, combustion systems may use one or more voltage power supplies, and one or more flame anchoring electrodes for repelling or attracting a charged flame in order to anchor the flame to a certain position within the combustion system. The charged flame may be generated by at least one charging electrode separate from the one or more flame anchoring electrodes, which is disposed near a flame within the combustion system and configured to inject charges into the flame to impart a net charge/polarity to the flame. In some embodiments, the life span of each of the one or more flame anchoring electrodes and at least one charging electrode may be extended because no contact with the flame is established or required. In addition, the flame anchoring electrode may exhibit a toric shape, such as an annulus shape having a diameter larger than an average diameter of the flame. Such a relationship may enhance flame anchoring by avoiding electrical isolation effect provided by the air gap between the flame and the flame anchoring electrode.

FIG. 1 illustrates an embodiment of a combustion system 100 that includes include a nozzle 102 or other type of burner configured to output fuel that ignites with an oxidizer (e.g., air or other oxidizer) to generate a flame 104 in a combustion volume; one or more annular flame anchoring electrode(s) 106 configured to anchor the flame 104 via electrodynamic interaction with the flame 104; and at least one charging electrode 108 configured to emit charges into the flame 104 to impart a net charge/polarity to the flame 104. In some embodiments, the fuel may be premixed with the oxidizer, and the fuel and oxidizer may exit the nozzle 102 together therewith.

The flame anchoring electrode(s) 106 and the at least one charging electrode 108 may each be made from a suitable electrically conductive material, such as a metal or an alloy. Anchoring of the flame 104 may include attachment of the flame 104 to and/or positioning of the flame 104 in a certain area at or near the flame anchoring electrode(s) 106 in such a way that the flame 104 may stay in contact with or be confined to areas proximate to that the flame anchoring electrode(s) 106. In some embodiments, the flame anchoring electrode(s) 106 and at least one charging electrode 108 may be positioned and configured so that they are not in contact with the flame 104 during operation. According to various other embodiments, anchoring of the flame 104 may be suitable for use with a large variety of fuels in different combustion applications, such as gas, liquid, and solid fuels, which may be injected through a burner, an injector or the nozzle 102.

The flame anchoring electrode(s) 106 may exhibit a number of different shapes, quantities, and sizes according to desired characteristics of the flame 104. In the illustrated embodiment, the flame anchoring electrode(s) 106 is a single, complete annular flame anchoring electrode. However, in other embodiments, the flame anchoring electrode(s) 106 may exhibit different arrangements around the flame 104, such as a generally square shape, a generally triangular shape, or other suitable partial or complete toric body.

In the illustrated embodiment, the flame anchoring electrode(s) 106 and at least one charging electrode 108 may be biased by separate voltage power sources (114 and 116) by application of an AC or a DC voltage potential, which is operably coupled to a controller 117 that directs operation of the voltage power sources 114 and 116. For example, one or more of the voltage, charge, or electric fields may be applied with a plurality of waveforms and voltages/current intensities, according to a specific, desired position of the flame 104. However, in other embodiments, a single voltage power source may be employed. The controller 117 may be a programmable controller and/or may be controlled by any computing device such as a desktop computer, etc.

In operation, the flame 104 may be positively charged by emission of charges from the at least one charging electrode 108, resulting in the charged flame 104 carrying a majority of positively charged species 118. The flame 104 may alternatively be negatively charged, resulting from the charged flame 104 carrying a majority of negatively charged species. Additionally or alternatively, the charged flame 104 may carry a time-varying charge polarity resulting from alternately carrying a majority of positively charged species 118, then negatively charged species. For ease of understanding, the charge of the charged flame 104 will be considered to be positive in the following description. Moreover, it is currently believed by the inventors and experiments by the inventors have shown positive flame charge to be somewhat more effective for electrical flame holding that is negative flame charge.

The charge/polarity of the flame 104 may be generated by the at least one charging electrode 108 including a charge-ejecting electrode (e.g., a corona electrode that may be configured as a nail, a portion of a saw tooth blade, or other suitable charge-ejecting structure) that ejects charges into the flame 104, by an immersed or partially immersed charge depletion electrode, by an ion generator removed from proximity with the flame, by an inertial electrode, by other suitable structures, or combinations thereof. The at least one charging electrode 108 may be energized with the voltage power source 114 configured to apply a first voltage potential $V_1$, which may hold a constant positive charge or positive voltage potential. Alternatively, as described above, another constant or variable charge polarity may be selected by corresponding selection of an appropriate voltage power source.

The flame anchoring electrode(s) 106 may be located in proximity to the flame 104. For example, the flame 104 may have a first diameter and form an angle $\alpha$ 110 of about 3 to about 10 degrees (e.g., 7.5 degrees) in relation with a vertical reference axis 111. The flame anchoring electrode(s) 106 may have a second diameter that is larger than the first diameter of the flame 104. The second diameter may correspond to the projection of angle $\beta$ 112, which may be greater than angle $\alpha$ 110 ($\beta>\alpha$). This relationship between angles 110, 112 is intended to provide clearance between the flame 104 and flame anchoring electrode(s) 106.

In practice, because the flame anchoring electrode 106 may be positioned coaxially with and at an arbitrary distance away from a top surface of the nozzle 102 and the inside diameter of the flame anchoring electrode 106 is larger than the diameter of the flame 104, the relationship between these two diameters may be expressed in terms of angles formed between each of several features common to the combustion system 100. In particular, the diameter of the flame 104 may be expressed in terms of the first angle $\alpha$ 110 formed between a line 113 drawn substantially parallel to the vertical axis 111 through the flame 104 and tangent to a widest part of the flame 104 at point A and a line 115 extending from an inside edge of the nozzle 102 to the same point A. Likewise, the inside diameter of the flame anchoring electrode(s) 106 may be expressed in terms of the second angle $\beta$ 112 formed between a line 120 drawn substantially parallel to the vertical axis 111 and tangent with a point B along an inside edge of flame anchoring electrode(s) 106 and a line 119 extending from an inside edge of the nozzle 102 to the same point B. In some embodiments, it is desirable that diameter of the flame anchoring electrode(s) 106 be greater than the diameter of the flame 104 and, therefore, $\beta>\alpha$.

According to Coulomb's Law of charge repulsion, if the flame 104 needs to be anchored to a certain position, such as far away from tubes or pipes of heat exchangers, then the flame anchoring electrode(s) 106 may be charged by a second voltage power supply 116 at the second voltage potential $V_2$ that may exhibit a reverse/opposite polarity with respect to the charged flame 104. This may result in the charged flame 104 being pushed down and anchored to the flame anchoring electrode(s) 106 and in proximity to, but without making contact with the flame anchoring electrode(s) 106. Conversely, if the charged flame 104 needs to be lifted up and anchored above the flame anchoring electrode(s) 106, then the flame anchoring electrode(s) 106 may be charged with the same polarity as the flame 104. The flame anchoring electrode(s) 106 may also be placed within different regions or objects and may be positively or negatively charged to repel or attract the charged flame 104. Furthermore, the at least one charging electrode 108 may be located in different regions of the combustion system 100 including within a burner, an injector, or the nozzle 102.

Figure 2:
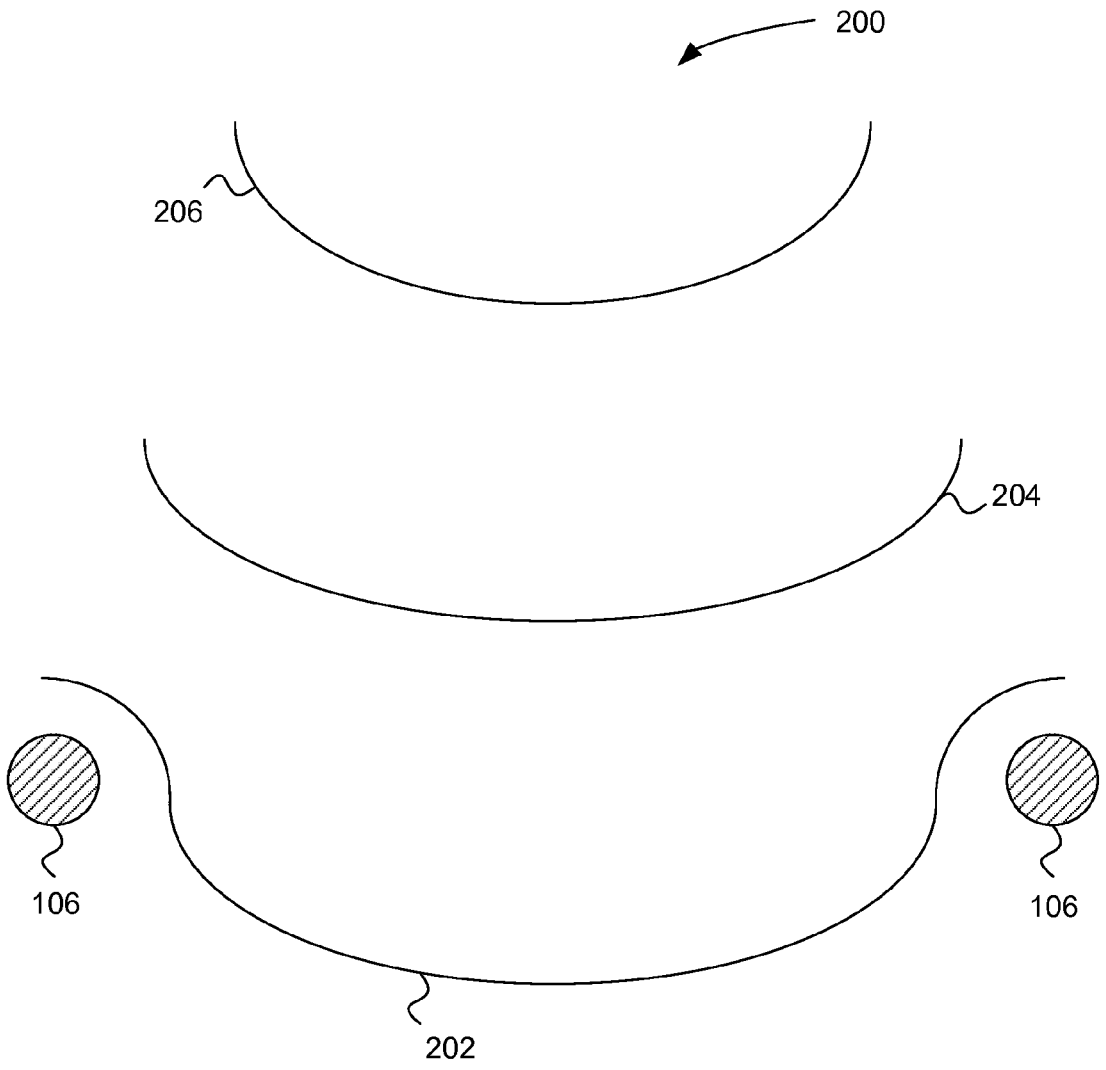
FIG. 2 is a schematic diagrammatic view illustrating a position of a flame in relation to a potential difference applied to flame, according to an embodiment.

FIG. 2 illustrates examples of different flame anchoring positions 200, with respect to the flame anchoring electrode(s) 106, which is depicted in cross-sectional view. The flame anchoring positions 200 may depend on the electrical potential difference between the charged flame 104 and flame anchoring electrode(s) 106, where a higher electrical potential difference may result in a stronger and nearer anchoring of the flame 104 to flame anchoring electrode(s) 106. For example, the charged flame 104 may be located at position 202 when a negative voltage of about 20 Kilo-volts (KV) may be applied to the flame anchoring electrode(s) 106, where position 202 may be slightly below an inner diameter of flame anchoring electrode(s) 106. Correspondingly, position 204 above the position 202 may be achieved by the application of a negative voltage of about 1 KV to the flame anchoring electrode(s) 106. Similarly, position 206 above the position 204 may be achieved when no voltage is applied to the flame anchoring electrode(s) 106.

Furthermore, the voltage potential required for anchoring the charged flame 104 may vary according to a flow rate of fuel and oxidizers and various other conditions during combustion such as, for instance, fuel constituents, fuel, pressure, temperature, and the like. In addition, if the charged flame 104 is required to be anchored in a higher or lower position, then retrofitting (not shown) may be easily provided for by simply re-locating flame anchoring electrode(s) 106 above or below the nozzle 102.

Figure 3:
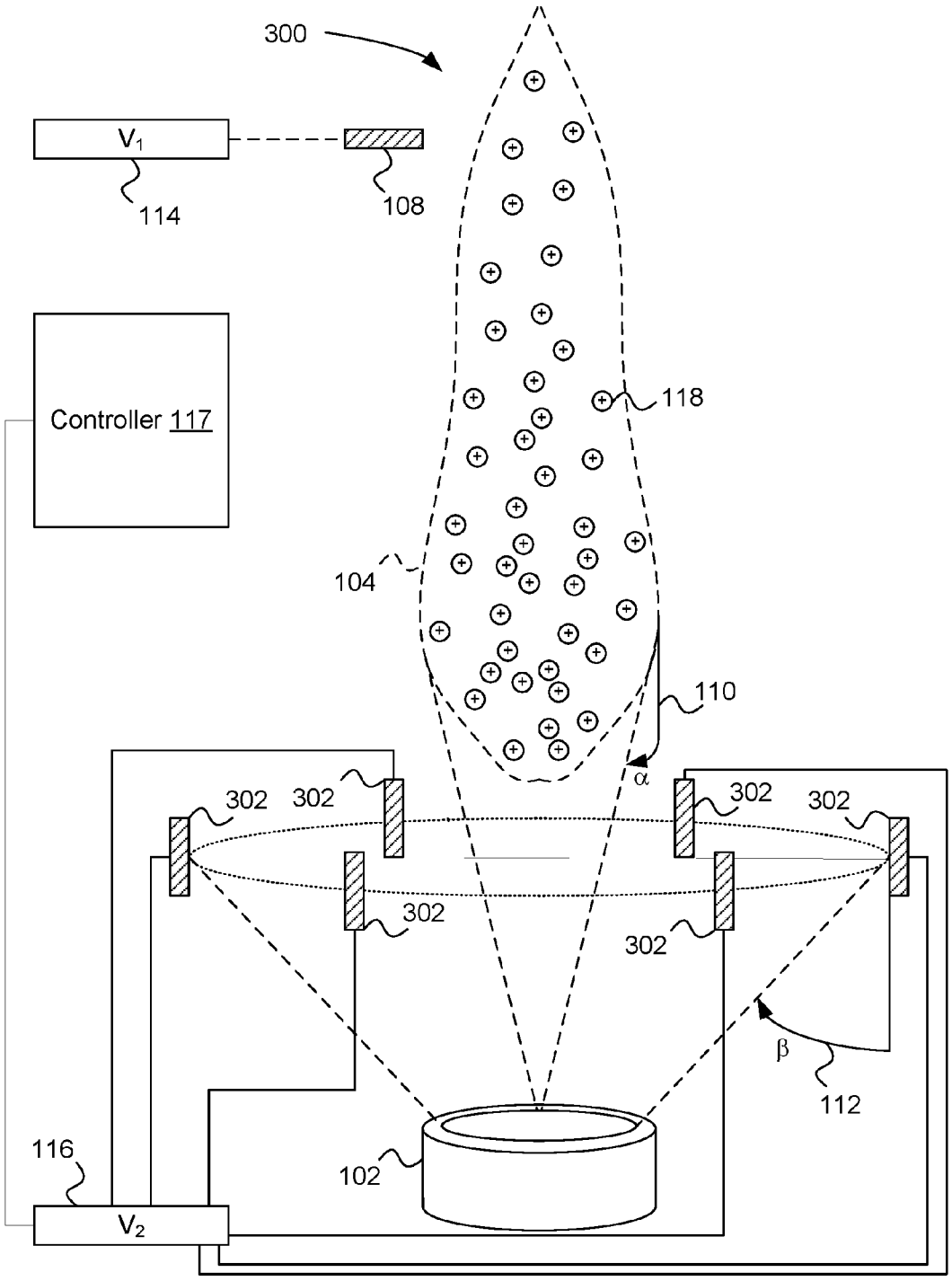
FIG. 3 is a schematic diagrammatic view of an embodiment of combustion system including a charging electrode and a group of flame anchoring electrodes for controlling an anchoring position of a flame.

FIG. 3 illustrates an embodiment of a combustion system 300 that employs the principles illustrated in FIGS. 1 and 2 and described in the foregoing detailed description. The combustion system 300 includes nozzle 102 configured to output fuel that ignites to form flame 104; at least one charging electrode 108; and a plurality of flame anchoring electrodes 302 spaced from each other and disposed peripherally about the flame 104 during operation. The plurality of flame anchoring electrodes 302 are configured to anchor the flame 104 via electrodynamic interaction with the flame 104. For example, the plurality of flame anchoring electrodes 302 may be circumferentially spaced from each other or laterally spaced from each other another manner. The plurality of flame anchoring electrodes 302 and at least one charging electrode 108 may be biased by separate voltage power sources 116 and 114 configured to apply an AC or a DC voltage potential $V_2$ and an AC or a DC voltage potential $V_1$, respectively thereto. Furthermore, in some embodiments, the plurality of flame anchoring electrodes 302 and at least one charging electrode 108 may be positioned and configured so that they are not in contact with the flame 104.

The plurality of flame anchoring electrodes 302 may be located in proximity to the flame 104, where the flame 104 edge may form an angle $\alpha$ 110 of, for example, about 7.5 degrees with respect to a vertical axis, as discussed above when describing the embodiment illustrated in FIG. 1. Moreover, the plurality of flame anchoring electrodes 302 may be circumferentially spaced from each and positioned along a diameter corresponding to the projection of angle $\beta$ 112, (again as discussed above with regard to FIG. 1) which may be greater than angle $\alpha$ 110 ($\beta>\alpha$), such that the diameter along which the plurality of flame anchoring electrodes 302 are positioned may be greater than a diameter of flame 104. This relationship between the angles 110 and 112 may provide clearance between flame 104 and segmented electrodes 302.

In some embodiments, each of the plurality of flame anchoring 302 may be biased to the same potential to attract or repel the charged flame 104. In another embodiment, different or separate voltage potentials may be applied to each of the plurality of flame anchoring electrodes 302 from individual power sources, such that individual voltage potentials may allow different flame anchoring positions 200 and other effects to the plurality of flame anchoring electrodes 302 flame 104. For example, one or more of the plurality of flame anchoring electrodes 302 may be charged to anchor the plurality of flame anchoring electrodes 302 flame 104, while the rest of the plurality of flame anchoring electrodes 302 may remain without any charge. In another embodiment, the plurality of flame anchoring electrodes 302 may be charged sequentially as required by the application.

In an embodiment, any of the methods described herein may be performed by a computer system having at least one processor configured to execute computer-executable instructions and process operational data. For example, the processor may be operably coupled to a memory storing an application including computer-executable instructions and operational data constituting a computer program to perform any of the methods disclosed herein and incorporated in a controller such as the controller 117 of FIGS. 1 and 3. For example, the processor may be operably coupled to a memory storing an application including computer executable instructions and operational data constituting a program to control combustion characteristics of a flame using combustion control systems 100 and/or 300.

The memory may be embodied as a computer readable medium, such as a random access memory ("RAM"), a hard disk drive, a static storage medium such as a compact disk, DVD, or other non-transitory storage medium. The memory may further store property data describing properties of the flame and/or electrode assemblies determined as described hereinabove. The computer system may further include a display coupled to the processor. The processor may be operable to display the images of the flame and other graphical illustrations of the characteristics of the flame on the display.

While various aspects and embodiments have been disclosed, other aspects and embodiments may be contemplated. The various aspects and embodiments disclosed here are for purposes of illustration and are not intended to be limiting, with the true scope and spirit being indicated by the following claims.

The invention claimed is:

1. A combustion system, comprising:

a burner configured to discharge fuel into a combustion volume in which the fuel and an oxidizer are ignited to generate a flame;

at least one charging electrode positioned proximate to the flame, the at least one charging electrode configured to emit charges into the flame to generate a charged flame exhibiting a net charge and/or polarity;

one or more flame anchoring electrodes disposed adjacent to the burner and proximate to a base portion of the charged flame; and at least one first voltage power supply electrically coupled to the at least one charging electrode, wherein the at least one charging electrode provides charges to the flame responsive to being biased by the first voltage power supply; and at least one second voltage power supply electrically coupled to the one or more flame anchoring electrodes, the at least one second voltage power supply configured to apply one or more electrical potentials to each of the one or more flame anchoring electrodes so that a base of the charged flame is stably positioned at a predetermined location, wherein the position of the base of the charged flame is spaced from the burner at the predetermined location.

2. The combustion system of claim 1 wherein the one or more flame anchoring electrodes are disposed peripherally about the burner.

3. The combustion system of claim 1 wherein the one or more flame anchoring electrodes includes a single flame anchoring electrode configured as a toric body.

4. The combustion system of claim 1 wherein the one or more flame anchoring electrodes includes a plurality of flame anchoring electrodes that are laterally spaced from each other.

5. The combustion system of claim 1 wherein the one or more flame anchoring electrodes includes a plurality of flame anchoring electrodes that are circumferentially spaced from each other.

6. The combustion system of claim 1 wherein the burner includes a nozzle configured to discharge the fuel.

7. The combustion system of claim 1 wherein the burner is configured to discharge the oxidizer mixed with the fuel.

8. The combustion system of claim 1 wherein the at least one second voltage power supply is configured to bias the one or more flame anchoring electrodes to exhibit a polarity opposite to that of the charged flame.

9. The combustion system of claim 1 wherein the at least one second voltage power supply is configured to bias the one or more flame anchoring electrodes to exhibit a polarity the same as that of the charged flame.

10. The combustion system of claim 1 wherein the one or more flame anchoring electrodes includes a plurality of flame anchoring electrodes, and wherein the at least one second voltage power supply is configured to bias each of the plurality of flame anchoring electrodes at different respective potentials.

11. The combustion system of claim 1 wherein the one or more flame anchoring electrodes includes a plurality of flame anchoring electrodes, and wherein the at least one second voltage power supply is configured to bias each of the plurality of flame anchoring electrodes at substantially the same potential.

12. The combustion system of claim 1 wherein the at least one charging electrode includes a corona electrode configured to emit charges into the flame.

13. The combustion system of claim 12, wherein the corona electrode includes at least one of a nail or a portion of a saw tooth blade.

14. The combustion system of claim 1 wherein the at least one charging electrode and the one or more flame anchoring electrodes do not contact the charged flame during operation.

15. The combustion system of claim 1, wherein the at least one charging electrode includes at least one of an at least partially immersed charge depletion electrode, an ion generator, or an inertial electrode.

16. The combustion system of claim 1, wherein the at least one second voltage power supply is configured to apply the one or more electrical potentials to each of the one or more flame anchoring electrodes so that a base of the charged flame changes position relative to the burner, wherein the position of the base of the charged flame is spaced from the burner.

17. A method for positioning a flame within a combustion volume, comprising:

discharging a flow including fuel from a burner into a combustion volume;

igniting the fuel and an oxidizer to generate a flame;

emitting charges from at least one charging electrode into the flame to generate a charged flame exhibiting a net charge and/or polarity; and applying an electrical potential to each of one or more flame anchoring electrodes positioned proximate to a base of the charged flame to stably position the base of the charged flame at a predetermined flame anchoring position that is spaced from the burner, wherein the flame anchoring position is different than the location of the charged flame when no electrical potential is applied to each of the one or more flame anchoring electrodes.

18. The method of claim 17 wherein the one or more flame anchoring electrodes are disposed peripherally about the burner.

19. The method of claim 17 wherein the one or more flame anchoring electrodes includes a single flame anchoring electrode.

20. The method of claim 17 wherein the one or more flame anchoring electrodes includes a plurality of flame anchoring electrodes that are laterally spaced from each other.

21. The method of claim 17 wherein the one or more flame anchoring electrodes includes a plurality of flame anchoring electrodes that are circumferentially spaced from each other.

22. The method of claim 17 wherein discharging a flow stream including fuel from a burner into a combustion volume includes discharging a mixture of the fuel and the oxidizer from the burner.

23. The method of claim 17 wherein applying an electrical potential to each of one or more flame anchoring electrodes positioned proximate to a base of the charged flame to stably positioning the base of the charged flame at a predetermined location includes biasing the one or more flame anchoring electrodes to exhibit a polarity opposite to that of the charged flame so that the base of the charged flame is attracted to the one or more flame anchoring electrodes.

24. The method of claim 17 wherein applying an electrical potential to each of one or more flame anchoring electrodes positioned proximate to a base of the charged flame to stably positioning the base of the charged flame at a predetermined location includes biasing the one or more flame anchoring electrodes to exhibit a polarity that is substantially the same to that of the charged flame so that the base of the charged flame is repelled from the one or more flame anchoring electrodes.

25. The method of claim 17 wherein applying an electrical potential to each of one or more flame anchoring electrodes positioned proximate to a base of the charged flame to stably positioning the base of the charged flame at a predetermined location includes biasing each of the one or more flame anchoring electrodes at different respective potentials.

26. The method of claim 17 wherein applying an electrical potential to each of one or more flame anchoring electrodes positioned proximate to a base of the charged flame to stably positioning the base of the charged flame at a predetermined location includes biasing each of the one or more flame anchoring electrodes at substantially the same potential.

27. The method of claim 17, further comprising selecting a voltage to be applied to each of the one or more anchoring electrodes to attract the base of the charged flame to the predetermined flame anchoring position, wherein the predetermined flame anchoring position is nearer to the one or more flame anchoring electrodes than if no voltage is applied to each of the one or more anchoring electrodes.

28. The method of claim 17, wherein applying an electrical potential to each of one or more flame anchoring electrodes to a base of the charged flame to stably position the charged flame at a predetermined flame anchoring position includes applying an electrical potential to each of the one or more flame anchoring electrodes to stably position the charged flame away from one or more of the at least one charging electrode, the one or more flame anchoring electrodes, walls, tubes, or pipes.

29. A combustion system, comprising:

a burner including a nozzle configured to discharge a mixture comprising fuel and air into a combustion volume in which mixture is ignited to generate a flame;

at least one corona electrode positioned proximate to the flame without making contact with the flame, the at least one corona electrode configured to emit charges into the flame;

a plurality of flame anchoring electrodes spaced from each other and disposed proximate to a base portion of the charged flame without making contact with the charged flame;

at least one voltage power supply electrically coupled to each of the plurality of flame anchoring electrodes and the at least one corona electrode, the at least one voltage power supply configured to apply one or more electrical potentials to each of the plurality flame anchoring electrodes so that a base of the charged flame is attracted to the plurality of flame anchoring electrodes, wherein the base of the charged flame is spaced from the burner.

* * * * *